US008566246B2

(12) United States Patent
Karandikar

(10) Patent No.: US 8,566,246 B2
(45) Date of Patent: Oct. 22, 2013

(54) HOSTED SYSTEM MONITORING SERVICE

(75) Inventor: Anirudha S. Karandikar, Cary, NC (US)

(73) Assignee: Red Hat, Inc., Raleigh, NC (US)

( * ) Notice: Subject to any disclaimer, the term of this patent is extended or adjusted under 35 U.S.C. 154(b) by 856 days.

(21) Appl. No.: 11/809,266

(22) Filed: May 30, 2007

(65) Prior Publication Data

US 2008/0298568 A1 Dec. 4, 2008

(51) Int. Cl.
*G06Q 30/00* (2012.01)

(52) U.S. Cl.
USPC ..... 705/52; 705/50; 705/51

(58) Field of Classification Search
USPC ..... 705/50–52
See application file for complete search history.

(56) References Cited

U.S. PATENT DOCUMENTS

| | | | | |
|---|---|---|---|---|
| 5,892,900 | A * | 4/1999 | Ginter et al. | 726/26 |
| 7,082,464 | B2 * | 7/2006 | Hasan et al. | 709/223 |
| 7,200,662 | B2 * | 4/2007 | Hasan et al. | 709/226 |
| 7,379,993 | B2 * | 5/2008 | Valdes et al. | 709/224 |
| 7,415,038 | B2 * | 8/2008 | Ullmann et al. | |
| 2001/0044840 | A1 * | 11/2001 | Carleton | 709/223 |
| 2002/0059078 | A1 * | 5/2002 | Valdes et al. | 705/1 |
| 2002/0156695 | A1 * | 10/2002 | Edwards | 705/26 |
| 2003/0110262 | A1 * | 6/2003 | Hasan et al. | 709/226 |
| 2004/0024717 | A1 * | 2/2004 | Sneeringer | 705/412 |
| 2005/0021588 | A1 * | 1/2005 | Zimmerman et al. | 709/200 |
| 2006/0176167 | A1 * | 8/2006 | Dohrmann | 340/506 |
| 2007/0150597 | A1 * | 6/2007 | Hasan et al. | 709/226 |
| 2008/0082374 | A1 * | 4/2008 | Kennis et al. | 705/7 |

OTHER PUBLICATIONS

InternetSupervision.com—Affiliate Agreement, https://secure.internetsupervision.com/affiliate/affiliate-tos.htm, Oct. 12, 2005, 2 pages.*

InternetSupervision.com—Prices, http://web.archive.org/web/20051013054428/http://internetsupervision.com/prices.asp?, Oct. 13, 2005, 2 pages.*

Internet Supervision.com Affiliate Agreement (https://secure.internetsupervision.com/affiliate/affiliate-tos.html, 2 pages, last updated Oct. 12, 2005).*

InternetSupervision.com—Prices (http://web.archive.org/web/20051013054428/http://internetsupervision.com/prices.asp, 2 pages, retrieved from page dated Oct. 13, 2005).*

* cited by examiner

*Primary Examiner* — James D Nigh
(74) *Attorney, Agent, or Firm* — Lowenstein Sandler LLP

(57) ABSTRACT

A method and apparatus for providing a system monitoring service to customers. The method may include identifying a new customer based on data received from a reseller, storing data pertaining to this customer in a database, and registering the customer with a system monitoring service. The method may further include tracking the usage of the system monitoring service by the customer, calculating a fee for the usage of the system monitoring service by the customer over a predefined time interval, and then generating a bill for the calculated fee that covers the predefined time interval, where interactions between the customer and the reseller terminate once the customer is registered with the system monitoring service.

20 Claims, 5 Drawing Sheets

HOSTED SYSTEM MONITORING SERVICE

TECHNICAL FIELD

Embodiments of the present invention relate to system monitoring, and more specifically to a hosted system monitoring service.

BACKGROUND

Computer networks have become increasingly complex while people have relied on computers coupled to the networks to transmit and fetch information. The computer networks are responsible for transporting information between the computers used in the business as well as allowing users to connect to their work from remote locations. Enterprise management systems have been developed to assist in monitoring networks and computers on the networks. Current information technology (IT) centers require monitoring of different IT assets including, for example, network devices, host computers, servers, operating systems and applications running on the above devices, websites provided by the above devices, etc.

Various schemes have been provided for distributing monitoring services to customers such as companies or other organizations. One known scheme involves a reseller that sells a service contract to the customer and maintains a relationship with the customer for the duration of the service contract, with the service provider having no access to customer. This scheme, however, has significant flaws because the reseller often does not posses full knowledge of the monitoring service and has to turn to the service provider for help, thus creating a delay in responding to the customer's inquiries and requests.

Another limitation of existing monitoring services is their billing approach. They typically request customers to subscribe for annual service and pay upfront for the entire year. This approach is especially inappropriate for businesses that are not well established financially or businesses whose network infrastructure changes throughout the year.

BRIEF DESCRIPTION OF THE DRAWINGS

The present invention is illustrated by way of example, and not by way of limitation, and can be more fully understood with reference to the following detailed description when considered in connection with the figures in which.

DETAILED DESCRIPTION

Figure 1:
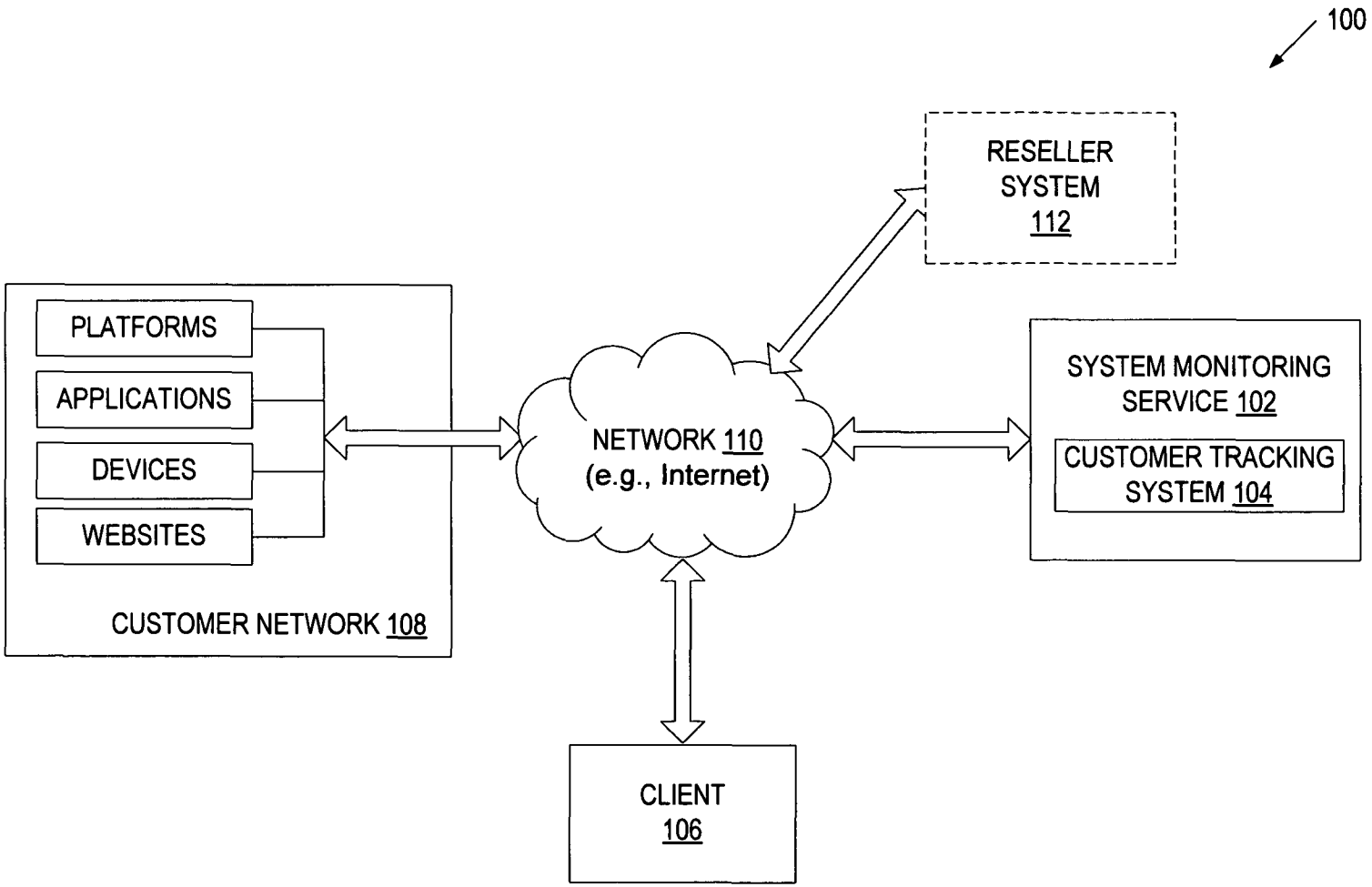
FIG. 1 is a block diagram of an exemplary architecture in which embodiments of the invention may be implemented.

Described herein is a method and apparatus for providing a system monitoring service to customers including various organizations (e.g., companies, government organizations, etc.). In one embodiment, once a provider of the system monitoring service (a service provider) receives data identifying a new customer from a reseller, the service provider stores data pertaining to this customer in a database, registers the customer, and makes the system monitoring service available to the customer (e.g., via a hosted website). The service provider may then track the usage of the system monitoring service by the customer, calculate the fee for the customer usage of the service over a predefined time interval (e.g., a month), and then generate a bill for the calculated fee that covers the predefined time interval. In one embodiment, interactions between the customer and the reseller terminate once the customer is registered with the system monitoring service In the following description, numerous specific details are set forth such as examples of specific systems, languages, components, etc. in order to provide a thorough understanding of the present invention. It will be apparent, however, to one skilled in the art that these specific details need not be employed to practice the present invention. In other instances, well known materials or methods have not been described in detail in order to avoid unnecessarily obscuring the present invention.

The present invention includes various steps, which will be described below. The steps of the present invention may be performed by hardware components or may be embodied in machine-executable instructions, which may be used to cause a general-purpose or special-purpose processor programmed with the instructions to perform the steps. Alternatively, the steps may be performed by a combination of hardware and software.

The present invention may be provided as a computer program product, or software, that may include a machine-readable medium having stored thereon instructions, which may be used to program a computer system (or other electronic devices) to perform a process according to the present invention. A machine-readable medium includes any mechanism for storing or transmitting information in a form readable by a machine (e.g., a computer). For example, a machine-readable medium includes a machine readable storage medium (e.g., read only memory ("ROM"), random access memory ("RAM"), magnetic disk storage media, optical storage media, flash memory devices, etc.), a machine readable transmission medium (electrical, optical, acoustical or other form of propagated signals (e.g., carrier waves, infrared signals, digital signals, etc.), etc.

Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

FIG. 1 illustrates an exemplary system architecture 100 in which embodiments of the present invention may operate. The system architecture 100 may include a customer network 108 (e.g., a private network such as a local area network (LAN) or Ethernet) that represents a network of an enterprise or some other organization. The network 108 may include such devices as desktop computers laptop computers, network printers, switches, routers, gateways, firewalls, or any other devices having a network address. The devices may host different operating system platforms (e.g., Linux, Windows®, Solaris, etc.), run different applications, provide different network services or websites, etc. The components of the customer network 108 (e.g., devices, platforms, applications and websites) are collectively referred to herein as information technology (IT) assets.

A system monitoring service 102 represents a system that is coupled to the customer network 108 via a public or private network 110 (e.g., Internet or LAN). The system monitoring service 102 can be implemented as software, hardware or a combination of both. The system monitoring service 102 is offered by a service provider to facilitate monitoring of the IT assets within the customer network 108. Based on the monitoring, the system monitoring service 102 generates alert notifications (e.g., status or problem alerts) for system administrators or other users via email or pagers, and provides reports requested by system administrators or other users. In one embodiment, the system monitoring service 102 is hosted by a service provider to facilitate effective monitoring of the customer network 108, without requiring the customer to customize and maintain a monitoring system on-site.

A client 106 includes a browser application that allows a user (e.g., a system administrator) to access the system monitoring service 102 (e.g., via a website) to configure the system monitoring service 102, request a report or some other data, or interact with the system monitoring service 102 in another way.

In one embodiment, the system monitoring service 102 includes a customer tracking system 104 that tracks the usage of the system monitoring service 102 by different customers and facilitates the billing of the customers based on their usage. One embodiment of the customer tracking system 104 will be discussed in more detail below in conjunction with FIG. 2.

In one embodiment, the architecture 100 includes a reseller system 112 maintained by a reseller that receives a service agreement from the system monitoring service 102 and onsells it to a new customer for profit or commission. For every new customer, the reseller system 112 provides information about the relevant new customer (e.g., name, contact information, service-level agreement, etc.) to the system monitoring service 102 that registers the new customer and stores their information in a database. Once the new customer is registered by the system monitoring service 102, the relationship between the reseller and the customer terminates, replaced by direct interactions of the customer with the system monitoring service 102. In one embodiment, the system monitoring service 102 calculates commission earned by the reseller and causes the commission to be paid to the reseller, as will be discussed in more detail below.

Figure 2:
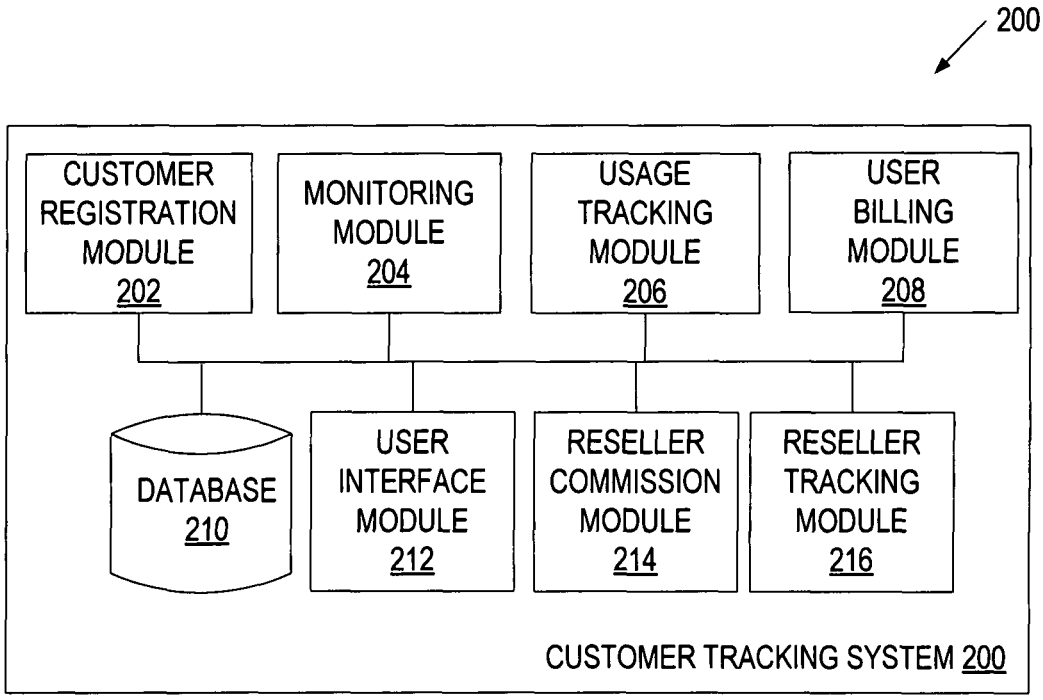
FIG. 2 is a block diagram of one embodiment of a customer tracking system.

FIG. 2 is a block diagram of one embodiment of a customer tracking system 200. The customer tracking system 200 includes a customer registration module 202, a monitoring module 204, a usage tracking module 206, a billing module 208, a user interface module 212, a database 210, a reseller commission module 214, and a reseller tracking module 216.

The customer registration module 202 receives information about new customers, registers them with the system monitoring service, and stores the customer information in the database 210. The customer information may be received from a reseller system, or via a website provided by the system monitoring service (e.g., entered by a customer's employee such as a system administrator). The customer information may include, for example, the customer name and contact information, data identifying the customer's service level agreement, characteristics of the customer network, etc.

The monitoring module 204 monitors IT assets of customers, sends alert notifications, generates reports and/or performs other functions requested by the customers. The usage tracking module 206 tracks the usage of the system monitoring service by the customers and stores the resulting data in the database 210. The customer usage may be tracked by time (e.g., how long the customer is actively using the service), by features (e.g., which monitoring, notification and reporting features are being provided to the customer), and/or various other parameters.

The user billing module 208 calculates the fee for the customer usage of the system monitoring service over a predefined time period (e.g., a month), stores the calculated fee in the database 210, and generates a bill based on the calculated fee. The fee may be calculated based on how long the customer was actively using the service, the features provided and used by the customer, and/or various other parameters (e.g., as defined in the customer's service level agreement).

The reseller tracking module 216 receives reseller data from different resellers and stores the reseller data in the database 210. The reseller data identifies individual resellers and customers that signed up for the system monitoring service via the individual resellers. If a customer changes a reseller, the reseller tracking module 216 receives data identifying the change and stores it in the database 210. The reseller tracking module 216 may receive reseller data from resellers at predefined time intervals (e.g., once a month) or when a change in reseller/client relationship occurs.

The reseller commission module 214 calculates reseller commissions and causes the commissions to be paid to relevant resellers. In one embodiment, the reseller commission module 214 periodically calculates commissions using reseller data and customer usage of the system monitoring service over a predefined time period. Alternatively, commissions may be calculated based on payments received from the customer rather than customer usage of the service or fees billed to customers. For example, the reseller commission module 214 may determine payments received from a customer over a current month, identify a reseller presently associated with this customer, calculate monthly commission to be paid to the reseller, store the commission data in the database 210, and generate a statement for the reseller. In another embodiment, the reseller commission module 214 may also (or instead) take into consideration a specific program or agreement currently in effect with the reseller when calculating the monthly commission for the reseller. For example, a reseller may have an agreement with the service provider to receive flat monthly fee for each customer regardless of customer usage of the system.

The user interface module 212 maintains a website for users (e.g., system administrators) to access the system monitoring service. The website may allow a user to register its company or organization with the system monitoring service, provide necessary data about the IT assets to be monitored, request specific functionality, receive reports or other data, etc.

Figure 3:
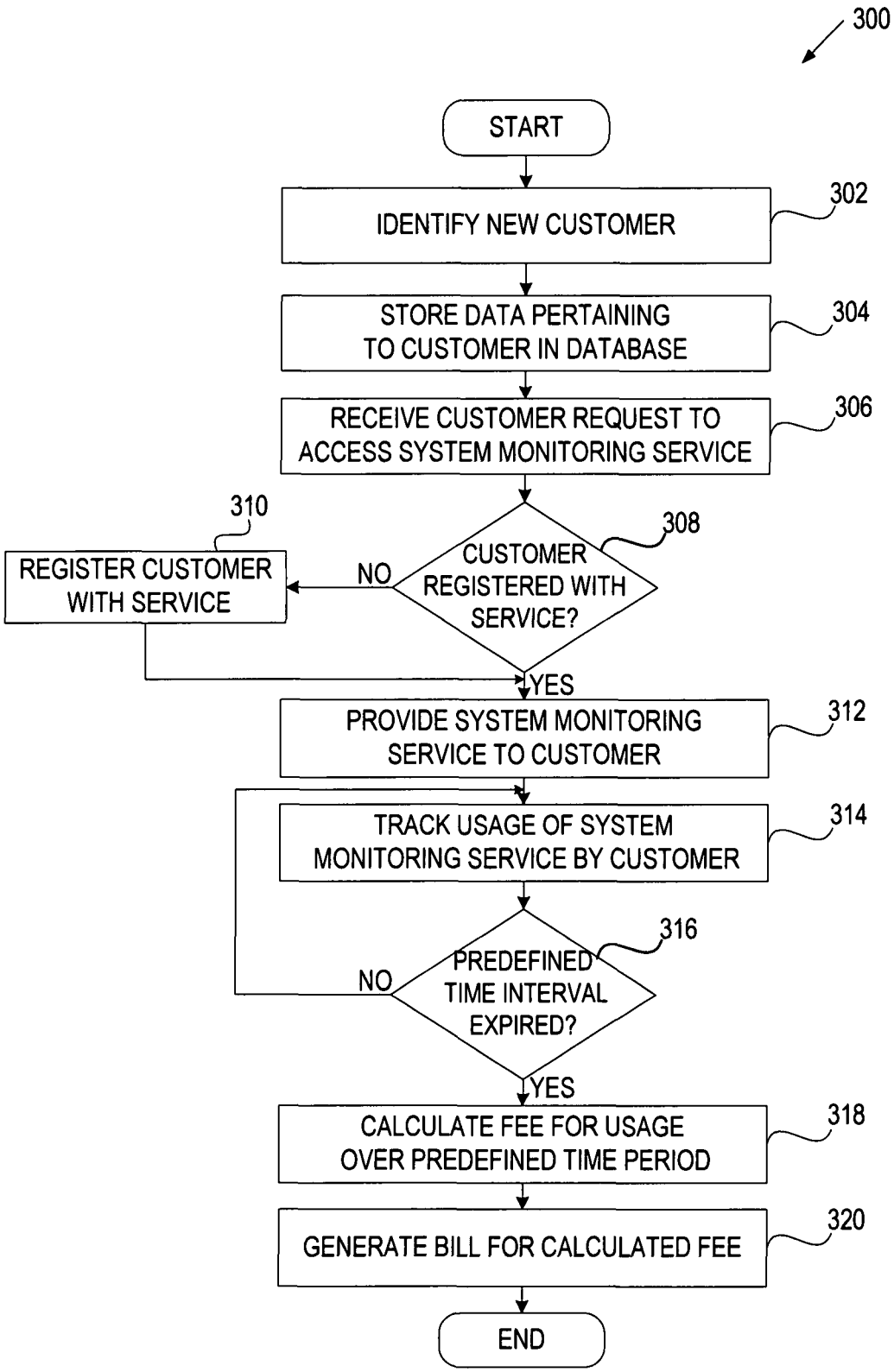
FIG. 3 is a flow diagram of one embodiment of a method for providing a system monitoring service.

FIG. 3 is a flow diagram of one embodiment of a method 300 for providing a system monitoring service to a customer.

The method may be performed by processing logic that may comprise hardware (e.g., circuitry, dedicated logic, programmable logic, microcode, etc.), software (e.g., instructions run on a processing device to perform hardware simulation), or a combination thereof. In one embodiment, the method is performed by a customer tracking system 104 of FIG. 1.

Referring to FIG. 3, method 300 begins with processing logic identifying a new customer for a system monitoring service (block 302). In one embodiment, the system monitoring service is a hosted by a service provider and is accessible to a user via a website maintained by the system monitoring service. Processing logic may identify a new customer based on a new customer request received via the website or based on data received from a reseller system.

At block 304, processing logic stores data pertaining to the new customer in a database The customer data may include, for example, the customer name and contact information, data identifying the customer's service-level contract, characteristics of the customer network, etc. Processing logic may also register the customer with the system monitoring service by creating a new customer identifier and storing it in the database with the customer data.

Subsequently, at block 306, processing logic receives a user request to access the system monitoring service (e.g., a via the website). In response, processing logic determines whether the user is associated with a registered customer (block 308). If so, processing logic proceeds to block 312. If not, processing logic registers the customer with the system monitoring service upon receiving the required data from the user (block 310), stores the data in the database as discussed above, and proceeds to block 312.

At block 312, processing logic provides the system monitoring service to the user. In particular, processing logic allows the user to configure the system monitoring service as desired, access report or other data, specify notification rules or other information, set billing preferences (e.g., monthly or bi-weekly billing), and/or perform some other interaction with the system monitoring service.

At block 314, processing logic tracks the usage of the system monitoring service by the customer. As discussed above, the tracking may be performed based on time, use of features or some other parameters.

At block 316, processing logic determines whether a predetermined time interval has expired. The predetermined time interval is an interval set for billing and may include a month, a quarter, two weeks, etc. If the predetermined time interval has expired, processing logic proceeds to block 318. If not, processing logic returns to block 314.

At block 318, processing logic calculates a fee for the customer usage of the system monitoring service over the predetermined time interval. At block 320, processing logic generates a bill for the calculated fee for the customer. As a result, the customer can pay for usage of the services on a periodic basis (e.g., monthly or bi-weekly), and can dynamically adjust the level of service depending on their needs and financial ability.

Figure 4:
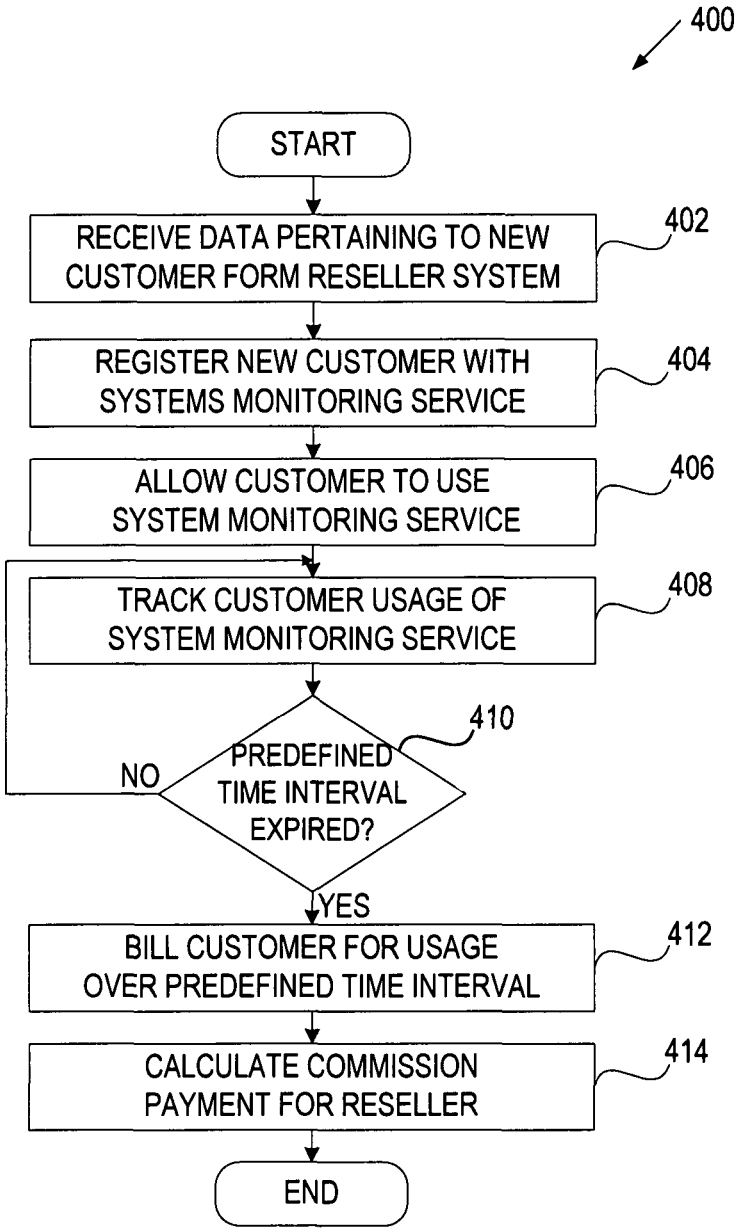
FIG. 4 is a flow diagram of one embodiment of a method for enabling a reseller model for a hosted system monitoring service.

FIG. 4 is a flow diagram of one embodiment of a method 400 for enabling a reseller model for a hosted system monitoring service. The method may be performed by processing logic that may comprise hardware (e.g., circuitry, dedicated logic, programmable logic, microcode, etc.), software (e.g., instructions run on a processing device to perform hardware simulation), or a combination thereof. In one embodiment, the method is performed by a customer tracking system 104 of FIG. 1.

Referring to FIG. 4, method 400 begins with processing logic receiving data pertaining to a new customer for a system monitoring service from a reseller system (block 402). The customer data may include, for example, the customer name and contact information, data identifying the customer's service-level contract, etc. At block 404, processing logic registers the new customer with the system monitoring service. The relationship between the customer and reseller then ends, replaced by direct interactions of the customer with the system monitoring service.

Subsequently, processing logic allows the customer to use the system monitoring service (block 406) as was discussed in more detail above. At block 408, processing logic tracks the usage of the system monitoring service by the customer. At block 410, processing logic determines whether a predetermined time interval has expired. If so, processing logic proceeds to block 412. If not, processing logic returns to block 408.

At block 412, processing logic bills the customer for usage of the system monitoring service over the predetermined time interval. At block 414, processing logic calculates commission payment for the reseller and causes the commission payment to be provided to the reseller.

Figure 5:
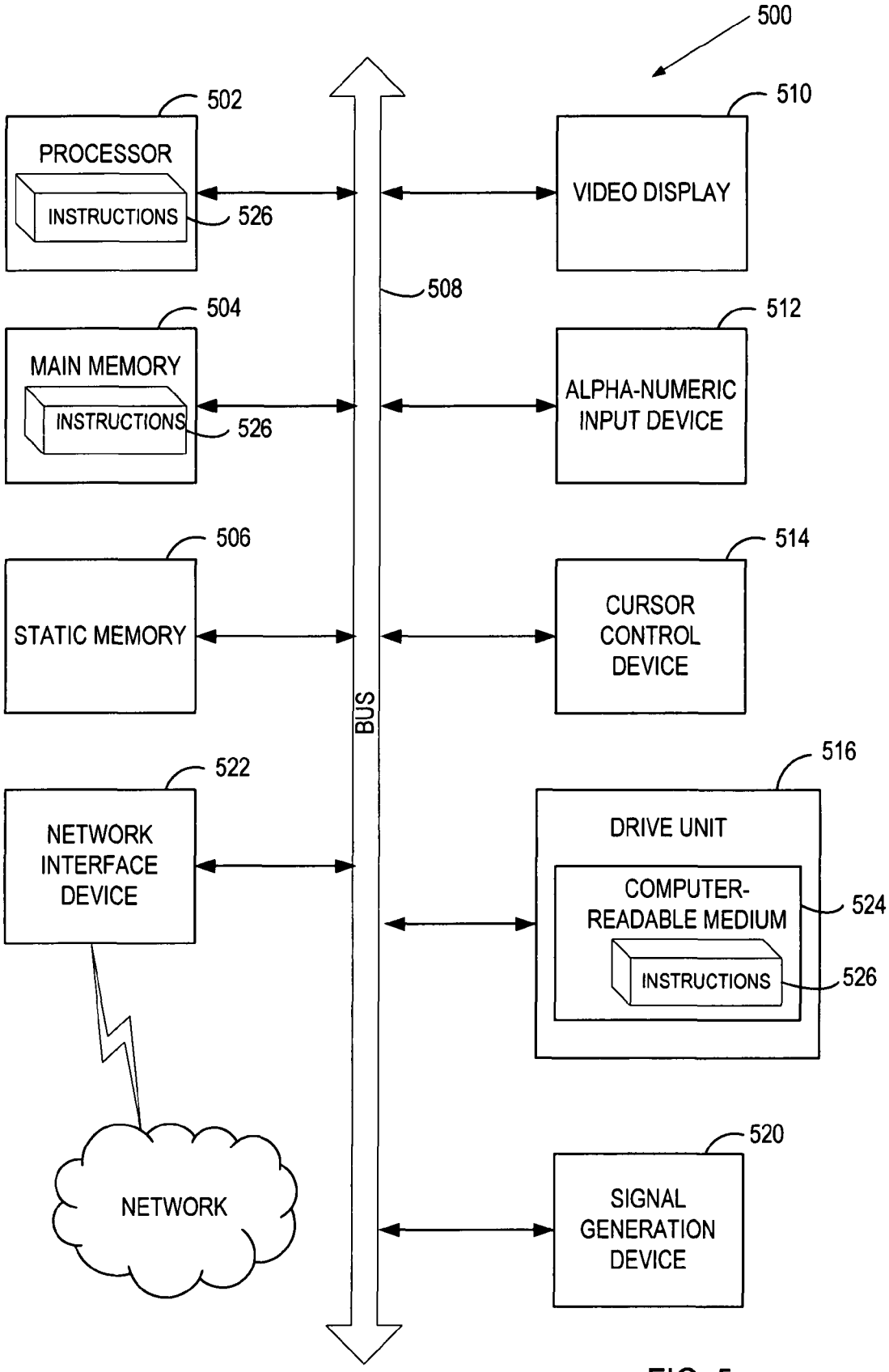
FIG. 5 illustrates a diagrammatic representation of a machine in the exemplary form of a computer system.

FIG. 5 illustrates a diagrammatic representation of a machine in the exemplary form of a computer system 500 within which a set of instructions, for causing the machine to perform any one or more of the methodologies discussed herein, may be executed. The machine may be connected (e.g., networked) to other machines in a LAN, an intranet, an extranet, or the Internet. The machine may operate in a client-server network environment, or as a peer machine in a peer-to-peer (or distributed) network environment. While only a single machine is illustrated, the term "machine" shall also be taken to include any collection of machines that individually or jointly execute a set (or multiple sets) of instructions to perform any one or more of the methodologies discussed herein. The machine may be a server, a personal computer, a mobile device, or any other device.

The exemplary computer system 500 includes a processing device 502, a main memory 504 (e.g., read-only memory (ROM), flash memory, dynamic random access memory (DRAM) such as synchronous DRAM (SDRAM) or Rambus DRAM (RDRAM), etc.), and a static memory 506 (e.g., flash memory, static random access memory (SRAM), etc.), which may communicate with each other via a bus 530. Alternatively, the processing device 502 may be connected to memory 504 and/or 506 directly or via some other connectivity means.

Processing device 502 represents one or more general-purpose processing devices such as a microprocessor, central processing unit, or the like. More particularly, the processing device may be complex instruction set computing (CISC) microprocessor, reduced instruction set computing (RISC) microprocessor, very long instruction word (VLIW) microprocessor, or processor implementing other instruction sets, or processors implementing a combination of instruction sets. The processing device 502 is configured to execute processing logic 526 for performing the operations and steps discussed herein.

The computer system 500 may further include a network interface device 522. It also may include a video display unit 510 (e.g., a liquid crystal display (LCD) or a cathode ray tube (CRT)), an alphanumeric input device 512 (e.g., a keyboard), a cursor control device 514 (e.g., a mouse), and/or a signal generation device 520 (e.g., a speaker).

The computer system 500 may also include a data storage device 516 having a machine-accessible storage medium 524 on which is stored one or more sets of instructions (e.g., software 526) embodying any one or more of the methodologies or functions described herein. The software 526 may also reside, completely or at least partially, within the main memory 504 and/or within the processing device 502 during execution thereof by the computer system 500, the main memory 504 and the processing device 502 also constituting machine-accessible storage media. The software 526 may further be transmitted or received over a network 520 via the network interface device 522.

While the machine-accessible storage medium 524 is shown in an exemplary embodiment to be a single medium, the term "machine-accessible storage medium" should be taken to include a single medium or multiple media (e.g., a centralized or distributed database, and/or associated caches and servers) that store the one or more sets of instructions. The term "machine-accessible storage medium" shall also be taken to include any medium that is capable of storing, encoding or carrying a set of instructions for execution by the machine and that cause the machine to perform any one or more of the methodologies of the present invention. The term "machine-accessible storage medium" shall accordingly be taken to include, but not be limited to, solid-state memories, optical and magnetic media, and carrier wave signals.

It is to be understood that the above description is intended to be illustrative, and not restrictive. Many other embodiments will be apparent to those of skill in the art upon reading and understanding the above description. The scope of the invention should, therefore, be determined with reference to the appended claims, along with the full scope of equivalents to which such claims are entitled.

What is claimed is:

1. A computer-implemented method, comprising:

receiving, by a computer system of a service provider, customer data identifying a new customer from a computer system of a reseller of a system monitoring service, the new customer having purchased the system monitoring service from the reseller for a customer network to be monitored by the system monitoring service hosted by the computer system of the service provider, the reseller system being coupled to the system monitoring service via a communications network;

storing, by the computer system of the service provider, the customer data received from the computer system of the reseller in a database;

registering, by the computer system of the service provider, the customer with the system monitoring service based on the customer data received from the computer system of the reseller to allow the customer network to be monitored by the system monitoring service;

monitoring, by the computer system of the service provider, the customer network, wherein monitoring includes providing a set of features of the system monitoring service to the customer;

tracking, by the computer system of the service provider, a usage of the set of features of the system monitoring service by the customer;

calculating, by the computer system of the service provider, a fee for the usage of the set of features of the system monitoring service by the customer over a predefined time interval;

generating, by the computer system of the service provider, a bill for the calculated fee covering the predefined time interval; and calculating, by the computer system of the service provider, a commission to be paid to the reseller based on the tracked usage of the set of features of the system monitoring service by the customer over the predefined time interval.

2. The method of claim 1 wherein the system monitoring service is a hosted service accessible to a user via a website.

3. The method of claim 2 wherein:

the customer is an organization;

the customer data comprises information concerning a plurality of information technology (IT) assets of the organization; and the user is a system administrator within the organization.

4. The method of claim 3 wherein the plurality of IT assets comprises one or more of platforms, applications, devices, or web sites.

5. The method of claim 3 wherein:

the customer data identifies a service level agreement of the customer; and the system monitoring service provides monitoring of the plurality of IT assets according to the service level agreement.

6. The method of claim 5 wherein the system monitoring service provides at least one of alert notifications and reports to the customer based on the monitoring.

7. The method of claim 1 wherein:

the predefined time interval comprises one month; and the fee is generated on a monthly basis.

8. The method of claim 1 further comprising:

receiving, by the computer system of the service provider, data identifying a service level contract signed by the new customer from the reseller.

9. The method of claim 1 wherein calculating the commission to be paid to the reseller comprises:

calculating, by the computer system of the service provider, the commission to be paid to the reseller for the predefined time period based directly on the usage of the set of features of the system monitoring service by the customer over the predefined time interval, or based on payments received from the customer, the payments being based on the tracked usage of the set of features of the system monitoring service by the customer over the predefined time interval.

10. A non-transitory computer-readable storage medium comprising computer-executable instructions which when executed by a computer cause the computer to perform the operations of:

receiving, by the computer, customer data identifying a new customer from a computer system of a reseller of a system monitoring service, the new customer having purchased the system monitoring service from the reseller for a customer network to be monitored by the system monitoring service hosted by the computer system of the service provider, the reseller system being coupled to the system monitoring service via a communications network;

storing, by the computer, the customer data received from the computer system of the reseller in a database;

registering, by the computer, the customer with the system monitoring service based on the data received from the computer system of the reseller to allow the customer network to be monitored by the system monitoring service;

monitoring, by the computer, the customer network, wherein monitoring includes a providing a set of features of the system monitoring service to the customer;

tracking, by the computer, a usage of the set of features of the system monitoring service by the customer;

calculating, by the computer, a fee for the usage of the set of features of the system monitoring service by the customer over a predefined time interval;

generating, by the computer, a bill for the calculated fee covering the predefined time interval; and calculating, by the computer, a commission to be paid to the reseller based on the tracked usage of the set of features of the system monitoring service by the customer over the predefined time interval.

11. The non-transitory computer-readable medium of claim 10 wherein the system monitoring service is a hosted service accessible to a user via a website.

12. The non-transitory computer-readable medium of claim 10 wherein:

the customer is an organization;

the customer data comprises information concerning a plurality of information technology (IT) assets of the organization; and the user is a system administrator within the organization.

13. The non-transitory computer-readable medium of claim 12 wherein:

the customer data identifies a service level agreement of the customer; and the system monitoring service provides monitoring of the plurality of IT assets according to the service level agreement.

14. The non-transitory computer-readable medium of claim 10 wherein calculating the commission to be paid to the reseller comprises:

calculating, by the computer, the commission to be paid to the reseller for the predefined time period based directly on the usage of the set of features of the system monitoring service by the customer over the predefined time interval, or based on payments received from the customer, the payments being based on the tracked usage of the set of features of the system monitoring service by the customer over the predefined time interval.

15. A computer system, comprising:

a memory having a database to store data pertaining to a customer; and a processor, coupled to the memory, to cause:

a customer registration module to receive customer data identifying a new customer from a computer system of a reseller of a system monitoring service, the new customer having purchased the system monitoring service from the reseller for a customer network to be monitored by the system monitoring service hosted by the computer system of the service provider, the reseller system being coupled to the system monitoring service via a communications network, and to register the customer with the system monitoring service based on the customer data received from the computer system of the reseller to allow the customer network to be monitored by the system monitoring service;

a monitoring module, coupled to the database, to monitor the customer network, wherein monitoring includes a providing a set of features of the system monitoring service to the customer;

a usage tracking module, coupled to the database, to track a usage of the set of features of the system monitoring service by the customer;

a billing module, coupled to the usage tracking module, to calculate a fee for the usage of the set of features of the system monitoring service by the customer over a predefined time interval, and to generate a bill for the calculated fee covering the predefined time interval; and a reseller commission module, coupled to the usage tracking module, to calculate a commission to be paid to the reseller based on the tracked usage of the set of features of the system monitoring service by the customer over the predefined time interval.

16. The system of claim 15 wherein the system monitoring service is a hosted service accessible to a user via a website.

17. The system of claim 15 further comprising:

a monitoring module, coupled to the database, to provide monitoring of a plurality of information technology (IT) assets, and to provide at least one of alert notifications and reports to the customer based on the monitoring.

18. The system of claim 15 wherein the reseller commission module is to calculate the commission based directly on the tracked usage of the set of features of the system monitoring service by the customer over the predefined time interval.

19. The system of claim 15 wherein the reseller commission module is to calculate the commission based on a payment received from the customer for the predefined time period, the payment being based on the tracked usage of the set of features of the system monitoring service by the customer over the predefined time interval.

20. The method of claim 1, wherein tracking, by the computer system of the service provider, a usage of the set of features of the system monitoring service by the customer includes tracking which monitoring, notification and reporting features are provided to the customer.

* * * * *